United States Patent [19]

Schneider et al.

[11] Patent Number: 4,898,244

[45] Date of Patent: Feb. 6, 1990

[54] INSTALLATION OF DOWNHOLE PUMPS IN WELLS

[76] Inventors: John L. Schneider, Beech Wood Place; Hugo M. Barcia, 18 Bremen Drive, both of West Hill, Skene, Aberdeenshire, United Kingdom

[21] Appl. No.: 235,891

[22] PCT Filed: Dec. 14, 1987

[86] PCT No.: PCT/GB87/00903

§ 371 Date: Aug. 12, 1988

§ 102(e) Date: Aug. 12, 1988

[87] PCT Pub. No.: WO88/04353

PCT Pub. Date: Jun. 16, 1988

[30] Foreign Application Priority Data

Dec. 12, 1986 [GB] United Kingdom ..... 8629746

[51] Int. Cl.[4] ..... E21B 43/116; E21B 43/00

[52] U.S. Cl. ..... 166/297; 166/55.1; 166/105; 166/106; 166/369; 166/378

[58] Field of Search ..... 166/297, 378, 381, 369, 166/55.1, 105, 106

[56] References Cited

U.S. PATENT DOCUMENTS

| | | | |
|---|---|---|---|
| 3,856,094 | 12/1974 | Davis | 175/4.52 |
| 3,856,335 | 12/1974 | Blake | 285/286 |
| 3,923,105 | 12/1975 | Lands, Jr. | 175/4.55 |
| 4,616,701 | 10/1986 | Stout et al. | 166/55.1 |
| 4,693,317 | 9/1987 | Edwards et al. | 166/55.1 X |

OTHER PUBLICATIONS

Way et al., "Engineers Evaluate Submersible Pumps in North Sea Field", Petroleum Engineer International, Jul. 1982, pp. 92, 94, 96, 98–100, 104, 108 and 112.

*Primary Examiner*—Hoang C. Dang

*Attorney, Agent, or Firm*—Florence U. Reynolds

[57] ABSTRACT

A downhole pump and perforating gun are run simultaneously down a well on a tubing string and the gun is fired under underbalanced conditions. A slip joint reduces vertical mechanical shock transmitted through the tubing string to the pump on firing; centralizers minimize whiplash vibration and a lateral shock absorber absorbs radial shock.

20 Claims, 3 Drawing Sheets

INSTALLATION OF DOWNHOLE PUMPS IN WELLS

This invention relates to a method of, and apparatus for, installing a downhole pump in a well such as, for example, an oil well in a low-pressure depleted reservoir or a new well with a low natural flow rate which is to be completed.

The present procedure for perforating an oil well is first to fire the perforators and then to kill the well to allow the pump(s) to be lowered. Not only is this a cumbersome and time-consuming procedure, but killing the well impairs the efficiency of perforators. It was previously thought impossible to run a downhole pump simultaneously with a tubing conveyed perforator because of the damage which would, it was thought, be suffered by the pump.

Such simultaneous running is permitted by the present invention according to a first aspect of which there is provided a method of installing a downhole pump in a well comprising simultaneously running a tubing conveyed perforator assembly and downhole pump, and firing the perforator assembly in underbalanced conditions while absorbing the transmission of resultant mechanical shock through the tubing.

Preferably the perforator assembly and tubing are centralized during the firing, and radial shock generated by the firing is absorbed. Preferably again the pump assembly is arranged at a nodal point of vibration of the tubing string.

According to a second aspect of the present invention there is provided a downhole pump and perforator assembly combination a tubing string, a perforator assembly mounted at the lower end thereof, a pump assembly secured to the string at a position remote from the perforator assembly, and shock absorbing means for reducing vertical mechanical shock transmitted through the tubing string. The reduction is preferably achieved by a slip joint which allows relative upward movement of the lower portion of the string, thus forcing the fluid therein to be displaced.

Preferably the combination additionally comprises one or more of the following components:

(1) Centralizing means to restrain the perforator assembly from rocking on being fired and inducing whiplash vibration in the tubing string;

(2) Centralizing means to minimize any whiplash vibration induced in the tubing string;

(3) Shock absorbing means for absorbing the radial shock generated by firing the perforator assembly.

Preferably the impedance of the string to shock is increased by increasing the mass thereof, e.g., by increasing the dimensions of the by-pass string to which the pump assembly is clamped and clamping the assembly solidly to the by-pass string.

Preferably, also, the pump assembly is located at a nodal point for vibration of the string achieved by maximizing the mass of a Y-crossover located above the pump assembly, and of the pump assembly itself; by solidly clamping the assembly to the tubing string as mentioned above; and additionally by minimizing the clearance between the outside dimensions of the pump assembly and the internal diameter of the casing.

Moreover, the clearance of the perforator assembly with respect to the I/D of the casing should also be minimized.

By the use of the present invention the following advantages are afforded:

(1) The production index of the well is increased.

(2) The general benefits deriving from perforation with tubing conveyed perforating guns (which are bigger and better than conventional guns) are obtained, particularly (a) Perforation under high underbalanced conditions with resultant good, clean perforations allowing maximum unrestricted flow from the reservoir through the tunnels into the casing, thus minimizing flow of fines and eroded materials through the pump, and (b) Elimination of previous formation damage due to drilling or completion fluids.

(3) Rig time is saved by a reduction in the number of trips needed to complete the well.

(4) Production time is saved by elimination of the interval during which the well is killed after perforation.

(5) The tubing conveyed operation is simplified with respect to obtaining underbalanced and perforator detonation.

In practising the invention underbalanced must be achieved before the perforators are fired, preferably by using the pump, which allows its operation to be checked before perforation, and this method will subsequently be described in more detail. However other methods may be used, such as running a partially full, closed string (suitable only for new completions or work over wells with a very low natural flow rate) or pumping nitrogen down the annulus until enough volume has been displaced to obtain the desired underbalance.

When using the closed string method a special Y-tool is used to isolate the annulus and tubing when running in hole; the tubing may be run dry or partially filled with fluid. After the packer has been set opening tool and detonating bar are lowered by wire line, the Y-tool is opened after the wire line string is past the flow area, allowing fluid in the annulus to fill the empty tubing, thus obtaining underbalance.

The closed string method allows the well to be perforated in underbalance even if the pump fails later, and the packer to be set by a long string, saving a wire line trip; and if the Y-tool fails to open, the guns cannot be detonated. On the other hand the method entails the disadvantage that the pump ca-not be checked before the perforators are detonated.

The nitrogen method is useful if the pump fails after the pocket has been set and it is desired to perforate the well before replacing the pump. To perform the method a sliding sleeve above the Y-tool is opened; nitrogen is pumped down the annulus until enough volume has been displaced to obtain the desired underbalance; the sliding sleeve is closed, reverse flow being prevented by the provision of a check val e; and the perforating guns are detonated.

Although the invention may be carried out in a variety of ways, one particular embodiment thereof will now be described, by way of example with reference to the accompanying drawings in which FIG. 1 is a diagrammatic, vertical section through a lower portion of a well showing a tubing conveyed perforator (tcp)/downhole pump combination according to the invention before firing;

Figure 4:
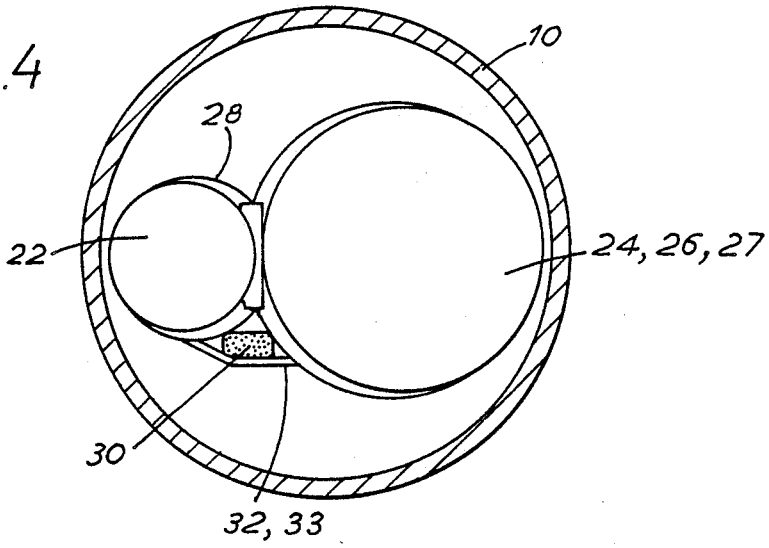
FIG. 4 is a detail of the shock absorber shown in FIGS. 1 and 2.

A tcp/downhole pump combination is located within a well bore casing 10, broken at 12, and terminating in a 17.8 cm liner 14. The combination is suspended from a production string 16, having a terminal portion passing through a dual packer 18, and a interposed inclined connector 20 and comprises a Y-crossover flow sub 19 from which depends a by-pass string 22 and tubing joint 23 leading to a pump 24, the intake of which is provided with a debris filtering screen 25, and tandem pump motors 26,27 both of which are solidly clamped to the by-pass string 22 by clamps 28 (see FIG. 4). The pump motors 26,27 are supplied by an electrical cable 30 secured by cable clamps 32,33. A PSI unit 34 is secured to the lower end of the motor 27.

The clearance between the pump assembly and the casing 10 is only 0.53 cm to help to establish it as a nodal point during vibration of the string.

Figure 1:
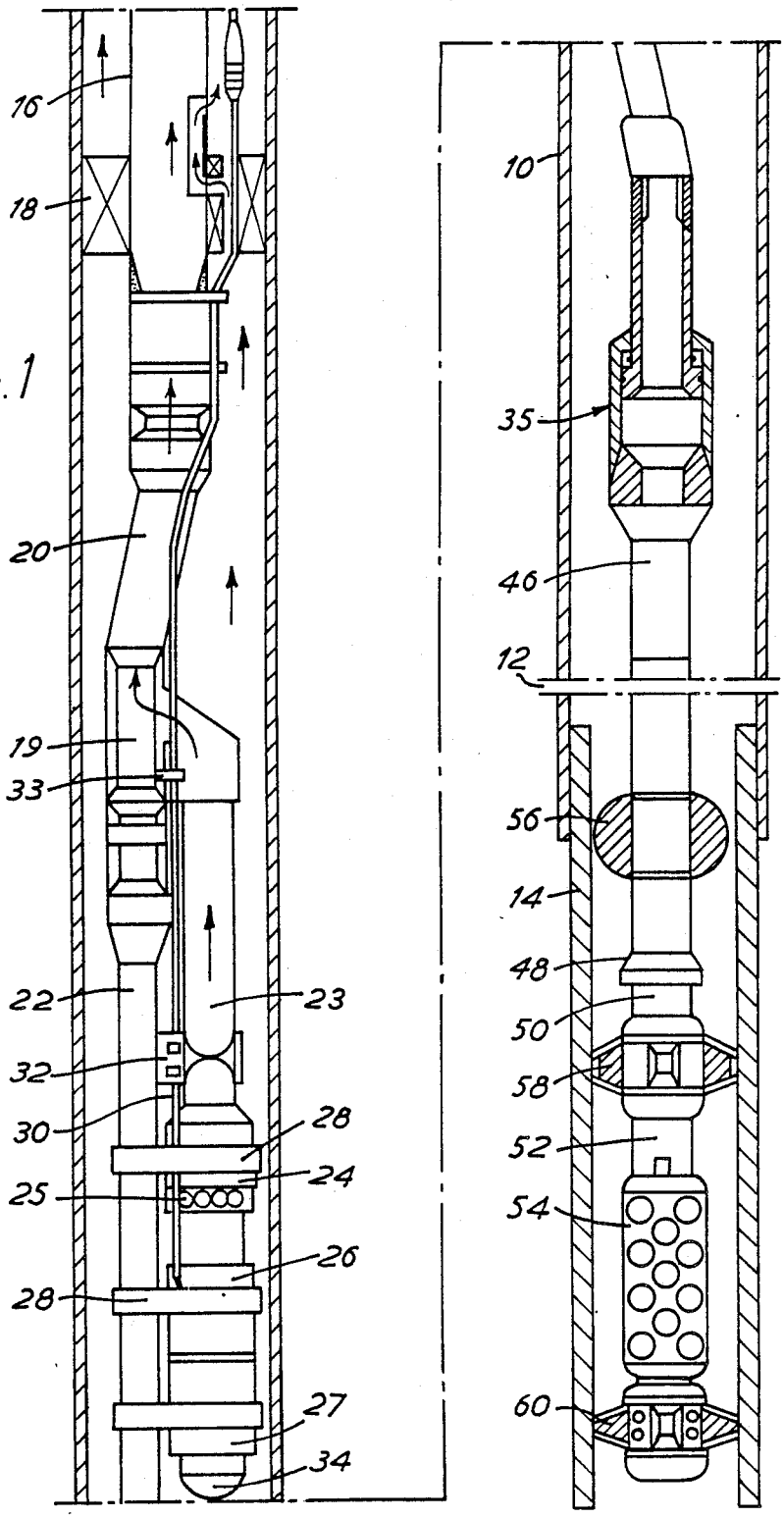
Figure 2:
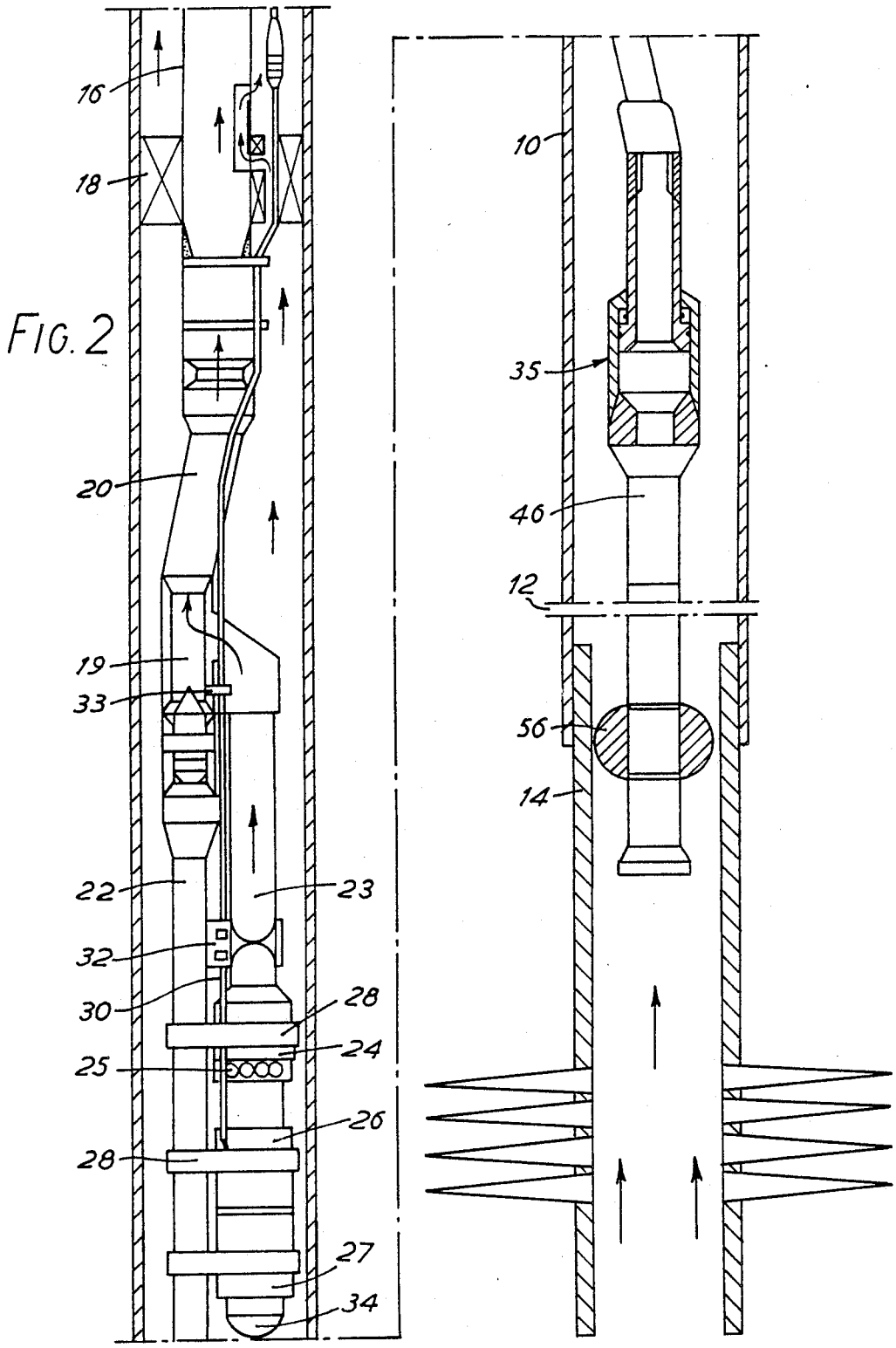
FIG. 2 is a section simi ar to that of FIG. 1, after firing.
Figure 3:
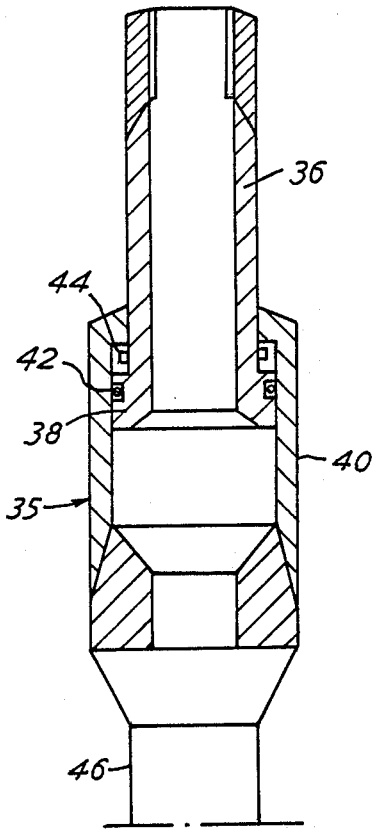
FIG. 3 is a horizontal section through the pump assembly shown in FIGS. 1 and 2.

Below the pump assembly is located a shock-absorbing slip joint 35 shown in more detail in FIG. 3 and comprising a hollow stem 36 which terminates in a recessed flange 38 and over the body of which is slidably and rotatably received the upper end of a cylindrical housing 40. To achieve a seal an O-ring 42 is received in the recess in the flange 38 and to absorb the shock of downward movement of the housing 40 a shock ring 44 is interposed between the shoulder of the flange 38 and the upper end of the housing 40. The ring 44 is made of a non-rubber material to ensure that rubber fragments resulting from disintegration of the ring are not drawn into the pump 24.

Suspended below the slip joint 35 by some 2,000 feet of 7.30 cm tubing 46 (instead of the normal 6.03 cm) is a perforating gun assembly comprising a gun release 48, pup joint 50, detonating head 52 and perforating guns 54. A tubing centralizer 56 is located between the pup joint 50 and the liner 14 and further centralizer 58 between the pup joint 50 and the liner 14.

Below the guns 54 is mounted a lateral shock absorber 60 to counteract rocking of the guns 54 induced by non-simultaneous detonation of explosive charges in the perforator guns.

To perforate the well the tcp/downhole pump combination is run down the we 1 to the illustrated position. After setting the packer 18 and with both the production string 16 and annulus between it and the casing 10 full, the pump 24 is operated to lower the level of fluid in the annulas until the reading from the PSI unit 34 indicates -hat the hydrostatic pressure corresponding to the selected underbalance has been reached; the reading is confirmed by comparing it with the volume of fluid pumped from the well.

If the natural flow rate of the well is sufficiently low the perforating guns 54 may be detonated by dropping a bar from the surface. If the natural flow rate is high, then the use of a slick line is recommended; by previously lowering the bar to a position near the detonating head 52, the perforating guns 54 may be detonated immediately after the selected underbalance has been achieved and the pump 24 has been switched off.

The advantages afforded by the above procedure are:

(1) The pump 24 is tested before perforation is effected;

(2) The head of hydrostatic pressure in the tubing 16 is higher than that in the annulus, generating a reverse flow through the pump 24 during the perforation operation, thus preventing solids from entering the pump 24;

(3) The well is allowed to flow under a decreasing drawdown as the level of fluid in the annulus is raised by the contribution from the tubing 16, permitting solids to drop to the bottom of the well.

The above method gives rise to the disadvantage that, before the pump 24 may be switched back on again, the reverse flow through the pump 24 should have ceased, otherwise the pump motors will be burned out: on the other hand waiting until flow through the pump 24 ceases can kill the well. This disadvantage may be overcome by installing a check valve (not shown) just above the pump 24 which will prevent reverse flow therethrough, and which will also prevent solids flowing through the pump 24. To ensure that the check valve is not leaking and causing the motors 26,27 to rotate, an ammeter may be installed at the surface to monitor whether any current is being generated by the rotating motors.

An advantage of the use of a check valve is that the packer may be set by pumping down the string without having to run a blanking plug.

We claim:

1. A method of installing a downhole pump in a well comprising the steps of running a tubing-conveyed perforator assembly, including a perforating gun, and a downhole pump down the well simultaneously by means of a tubing string, and firing the perforating gun in underbalanced conditions while absorbing transmission of resultant mechanical shock through the tubing string.

2. A method as claimed in claim 1, wherein the perforator assembly and tubing string are central during the firing.

3. A method as claimed in claim 1 wherein the radial shock generated by the firing is absorbed.

4. A method as claimed in claim 1 wherein the pump is arranged at a nodal point of vibration of the tubing string.

5. A downhole pump and perforator assembly combination comprising a tubing string, a perforator assembly including a perforating gun mounted at the lower end of said tubing string, a pump assembly secured to the tubing string at a position remote from the perforator assembly, and shock absorbing means interposed in a by-pass string connected to said tubing string for reducing vertical mechanical shock transmitted through the tubing string.

6. A combination as claimed in claim 5, in which said shock absorbing means comprise a slip joint which allows relative upward movement of the lower portion of the tubing string with respect to the by-pass string, thus forcing the fluid therein to be displaced.

7. A combination claimed in claim 5, further comprising centralizing means for restraining the perforator assembly from rocking on being fired and inducing whiplash vibration in the tubing string for minimizing any whiplash vibration induced in the tubing string.

8. A combination as claimed in claim 5 further comprising shock absorbing means for absorbing the radial shock generated by firing the perforating gun.

9. A combination as claimed in 5 in which the mass of the tubing string is increased to increase its impedance to shock.

10. A combination as claimed in claim 5 in which the pump assembly is located at a nodal point for vibration of the tubing string.

11. A method as claimed in claim 2, wherein the pump is arranged at a nodal point of vibration of the tubing string.

12. A method as claimed in claim 3, wherein the pump is arranged at a nodal point of vibration of the tubing string.

13. A combination as claimed in claim 6, in which the mass of the tubing string is increased to increase its impedance to shock.

14. A combination as claimed in claim 7, in which the mass of the tubing string is increased to increase its impedance to shock.

15. A combination as claimed in claim 8, in which the mass of the tubing string is increased to increase its impedance to shock.

16. A combination as claimed in claim 6, in which the pump assembly is located at a nodal point for vibration of the tubing string.

17. A combination as claimed in claim 7, in which the pump assembly is located at a nodal point for vibration of the tubing string.

18. A combination as claimed in claim 8, in which the pump assembly is located at a nodal point for vibration of the tubing string.

19. A combination as claimed in claim 9, in which the pump assembly is located at a nodal point for vibration of the tubing string.

20. A combination as claimed in claim 13, in which the pump assembly is located at a nodal point for vibration of the tubing string.

* * * * *